US007063065B1

(12) United States Patent
Swenson

(10) Patent No.: US 7,063,065 B1
(45) Date of Patent: Jun. 20, 2006

(54) FOUR CYCLE, PISTON-DRIVEN, ROTARY PORTED INTAKE AND EXHAUST SUPER ATMOSPHERICALLY CHARGED ON DEMAND INTERNAL COMBUSTION ENGINE

(76) Inventor: Jerry L. Swenson, 1227 Upland Hills Dr. So, Upland, CA (US) 91786

( * ) Notice: Subject to any disclaimer, the term of this patent is extended or adjusted under 35 U.S.C. 154(b) by 0 days.

(21) Appl. No.: 11/032,909

(22) Filed: Jan. 10, 2005

(51) Int. Cl.
*F02B 75/02* (2006.01)

(52) U.S. Cl. ..... 123/317; 123/80 BA

(58) Field of Classification Search ..... 123/80 BA, 123/190.2, 317, 318
See application file for complete search history.

(56) References Cited

U.S. PATENT DOCUMENTS 1,006,677 A * 10/1911 Plaut ..... 123/190.2
1,094,329 A * 4/1914 Henderson ..... 123/80 BA
1,142,312 A * 6/1915 Cusick ..... 123/190.2
1,794,061 A * 2/1931 Culver ..... 123/190.2

* cited by examiner

*Primary Examiner*—Noah P. Kamen
(74) *Attorney, Agent, or Firm*—Patent Venture Group

(57) ABSTRACT

Disclosed in the field of the four-cycle reciprocating piston internal combustion engine is an invention for a rotary ported intake and exhaust system and super-atmospherically charged on demand engine. This invention replaces the inefficient reciprocating valve system with a friction free rotating shaft with ports and passageways to produce the four cycles of the engine. It also replaces the accessory externally mounted compressors now used to super charge the engine by the use of two cylinders sharing the same minimum volume totally closed crankcase. As both pistons travel upward, they draw in air or air/fuel or that amount desired through a throttle body into the crankcase. As they travel downward, that cylinder on its intake cycle draws in air/fuel while the volume in the crankcase is compressed. Prior to the completion of the intake cycle, the crankcase pressure is released into that cylinder on its intake cycle super-atmospherically charging it. These cycles are then repeated for the other cylinder.

15 Claims, 5 Drawing Sheets

FOUR CYCLE, PISTON-DRIVEN, ROTARY PORTED INTAKE AND EXHAUST SUPER ATMOSPHERICALLY CHARGED ON DEMAND INTERNAL COMBUSTION ENGINE

BACKGROUND OF THE INVENTION

1. Field of the Invention

This invention relates generally to internal combustion engines, and more particularly to a four cycle, piston-driven, rotary ported intake and exhaust super atmospherically charged on demand internal combustion engine.

2. Description of the Related Art

In the field of the four cycle reciprocating piston internal combustion engine, I feel that the reciprocating valves now used for the intake and exhaust of the engine is one of the most inefficient motions. The reciprocating valves use many components to open and spring pressure to close during these cycles of the engine. They also require energy and create friction, noise, mechanical fatique, and engine revolutions per minute limitations. Manufacturing is also a large portion of the engine cost. As the revolutions per minute of the engine increase, the speed of the opening of the valves creates kinetic energy requiring stronger springs to close, increasing energy loss and friction. Many improvements have been made to reduce noise and kinetic energy by the use of hydraulic lifters and multiple lighter weight valves. All of these improvements increase manufacturing cost and further complicate the engine.

There is also known in the field of internal combustion high performance engines, a method for super-atmospherically charging an engine with the use of externally mounted mechanically driven or exhaust driven supercharger or turbocharger compressors. These require full time mechanical or exhaust restrictive energy. They are complex, expensive to manufacture and maintain.

All of these problems are eliminated with my four-cycle, piston driven, rotary ported intake and exhaust super-atmospherically charged on demand internal combustion engine.

BRIEF SUMMARY OF THE INVENTION

Disclosed is an invention for a four-cycle, piston driven, internal combustion engine that deletes or replaces the reciprocating intake and exhaust valve system now in use. It consists of rotary shafts with ports aligning to passageways in the combustion chamber, a passageway in the rotary shaft to a port, a linear dimension offset to provide a sealed area between these ports, aligning to a passageway in the cylinder head to the atmosphere.

One rotary shaft is used for the intake of the engine and the other for the exhaust. The shafts are mounted in close tolerance bores in the cylinder head above the compression chamber on both sides of the cylinder parallel to each other and the engine crankshaft. These shafts are supported by bearings and driven by the crankshaft at exactly one rotation to two crankshaft rotations to provide the four cycles. As the engine rotates these rotary shaft ports and passageways, they are timed to open and close to provide the intake cycle and exhaust cycles.

This invention also provides a method to super atmospherically charge the engine without the use of externally mounted mechanically driven or exhaust driven super charger or turbo charger compressors. It requires the use of two piston cylinders or multiples of two, sharing the same minimal volume crankcase chamber traveling in the same direction, one on its compression cycle, the other on its exhaust cycle, and the opposite on the next rotation. It also requires a passageway from the rotary shaft bore to the crankcase chamber, As the pistons start upward, they draw in through a throttle body and single direction valve fuel and air or the amount desired into the crankcase from the atmosphere. As the pistons start downward, the crankcase passageway is closed by the rotary shaft and the crankcase desired volume is compressed while the cylinder on its intake cycle draws in fuel and air/fuel through the throttle body and single-direction valve.

At a predetermined time, approximately 150 degrees after top dead center, the crankcase passageway is opened and the compressed volume of the crankcase is transferred to the cylinder on its intake cycle, super charging it. On the next upward stroke, this cycle is reversed. It should be noted that because of the single directional valve, the crankcase compressed volume cannot escape to the atmosphere and the throttle body controls the supercharge pressure on demand.

BRIEF DESCRIPTION OF THE SEVERAL VIEWS OF THE DRAWINGS

The invention, together with further advantages thereof, may best be understood by reference to the following description taken in conjunction with the accompanying drawings in which.

DETAILED DESCRIPTION OF THE INVENTION

Figure 1:
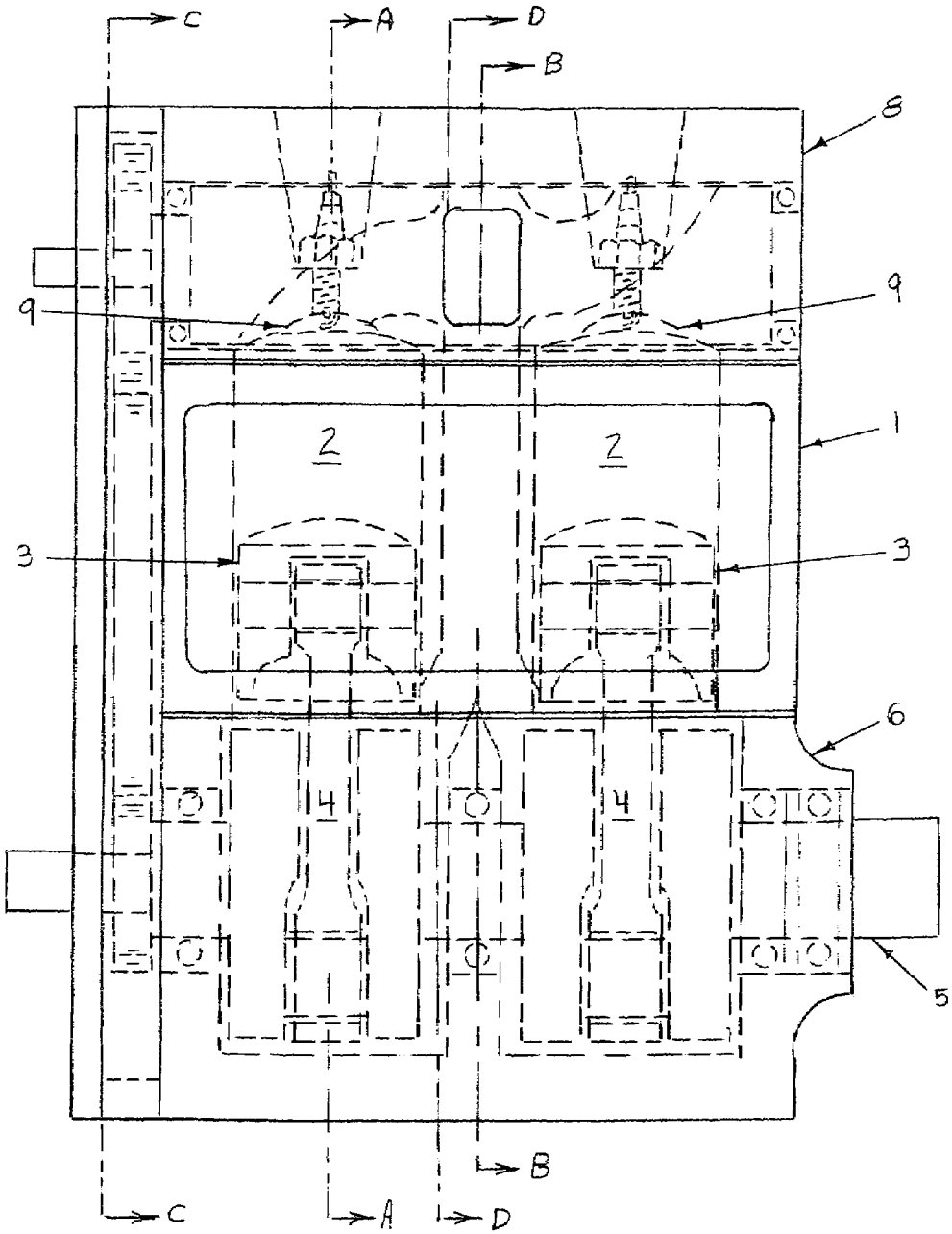
FIG. 1 is a longitudinal and sectional view of a four-cycle, piston driven, rotary ported intake and exhaust super atmospherically charged on demand internal combustion engine, in accordance with an embodiment of the present invention.

Referring to the drawings, FIG. 1 is a longitudinal and sectional view of a four-cycle, piston driven, rotary ported intake and exhaust super atmospherically charged on demand internal combustion engine, in accordance with an embodiment of the present invention. The internal combustion engine of FIG. 1 includes a cylinder block 1 with one or more cylinder piston bores 2 formed in the cylinder block. One or more pistons 3 reciprocate upward and downward by connecting rod 4 from piston 3 to a crankshaft 5 rotating in a crankcase block 6 fixed to the cylinder block 1. Fixed to the opposite end of the cylinder block 1 is a cylinder head 8 providing a closed end compression chamber 9, as illustrated next in FIG. 2.

Figure 2:
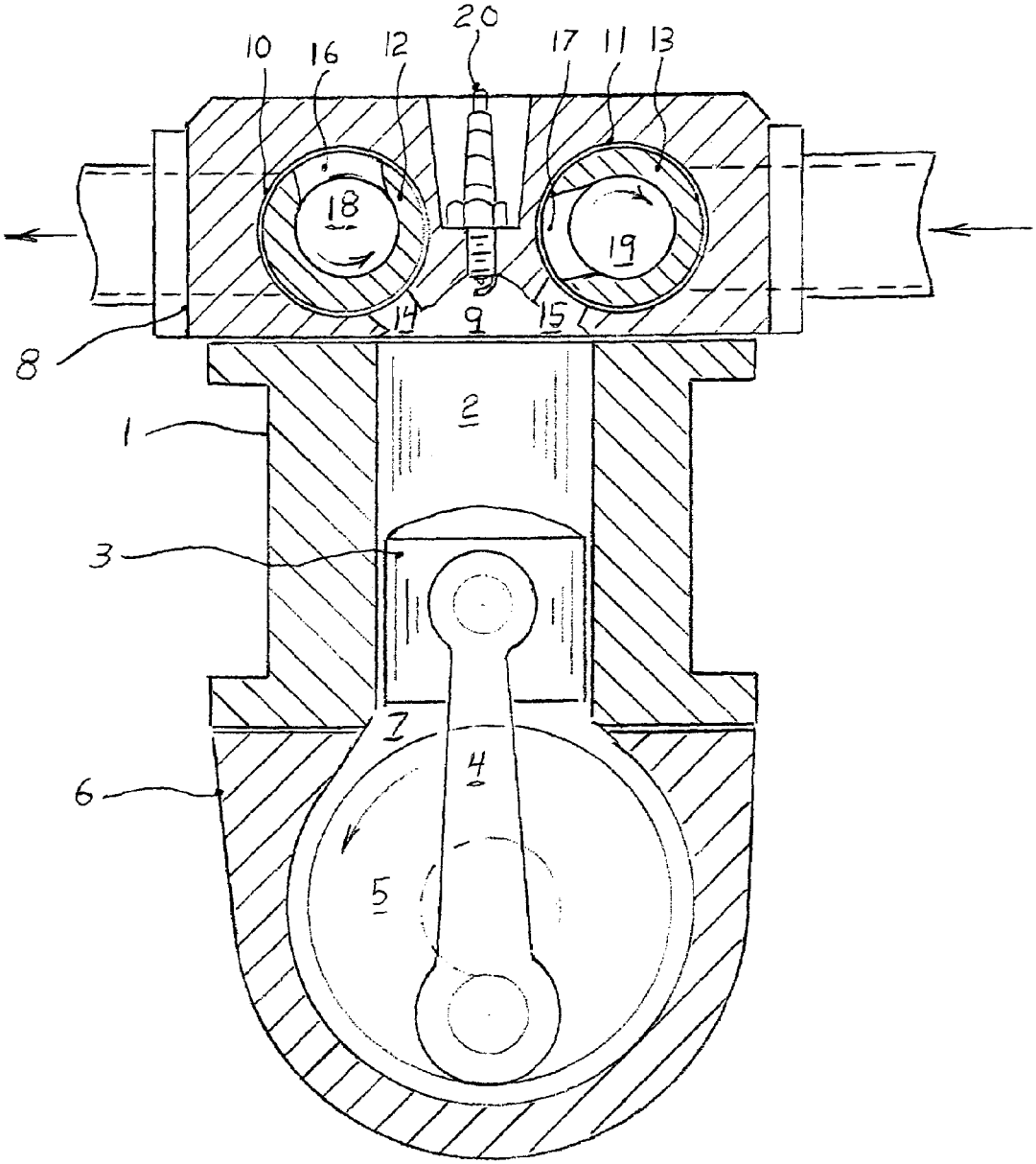
FIG. 2 is a sectional view through A—A of FIG. 1.

FIG. 2 is a sectional view through A—A of FIG. 1. As illustrated in FIG. 2, a spark plug 20 is fixed in the cylinder head compression chamber 9 to initiate combustion. Machined in the cylinder head 8 are two cylinder head rotary shaft precision bores 10, 11. Number 10 is the cylinder head exhaust rotary shaft bore and number 11 the cylinder head intake rotary shaft bore. These bores are perpendicular to the cylinder block piston bores 2 parallel to each other above and to both sides of the compression chamber 9 parallel to the crankshaft 5. Supported by bearings rotating in close clearance to the cylinder head exhaust and intake bores 10, 11 are two rotary shafts, exhaust rotary shaft 12 and intake rotary shaft 13. Machined in the compression chamber 9 to the exhaust rotary shaft bore 10 is a precision-compression chamber exhaust passageway 14 and from the compression chamber 9 to the intake rotary shaft bore 11 a precision compression chamber intake passageway 15. Machined in the exhaust rotary shaft 12 aligned with the compression chamber exhaust passageway 14 is a rotary shaft compression chamber exhaust port 16 and machined in the intake rotary shaft 13 aligned with the compression chamber intake passageway 15 a rotary shaft compression chamber intake port 17. Offset from the exhaust rotary shaft compression chamber port 16 along the exhaust rotary shaft 12 are multiple rotary shaft cylinder head exhaust ports 23, as illustrated next with reference to FIG. 3.

Figure 3:
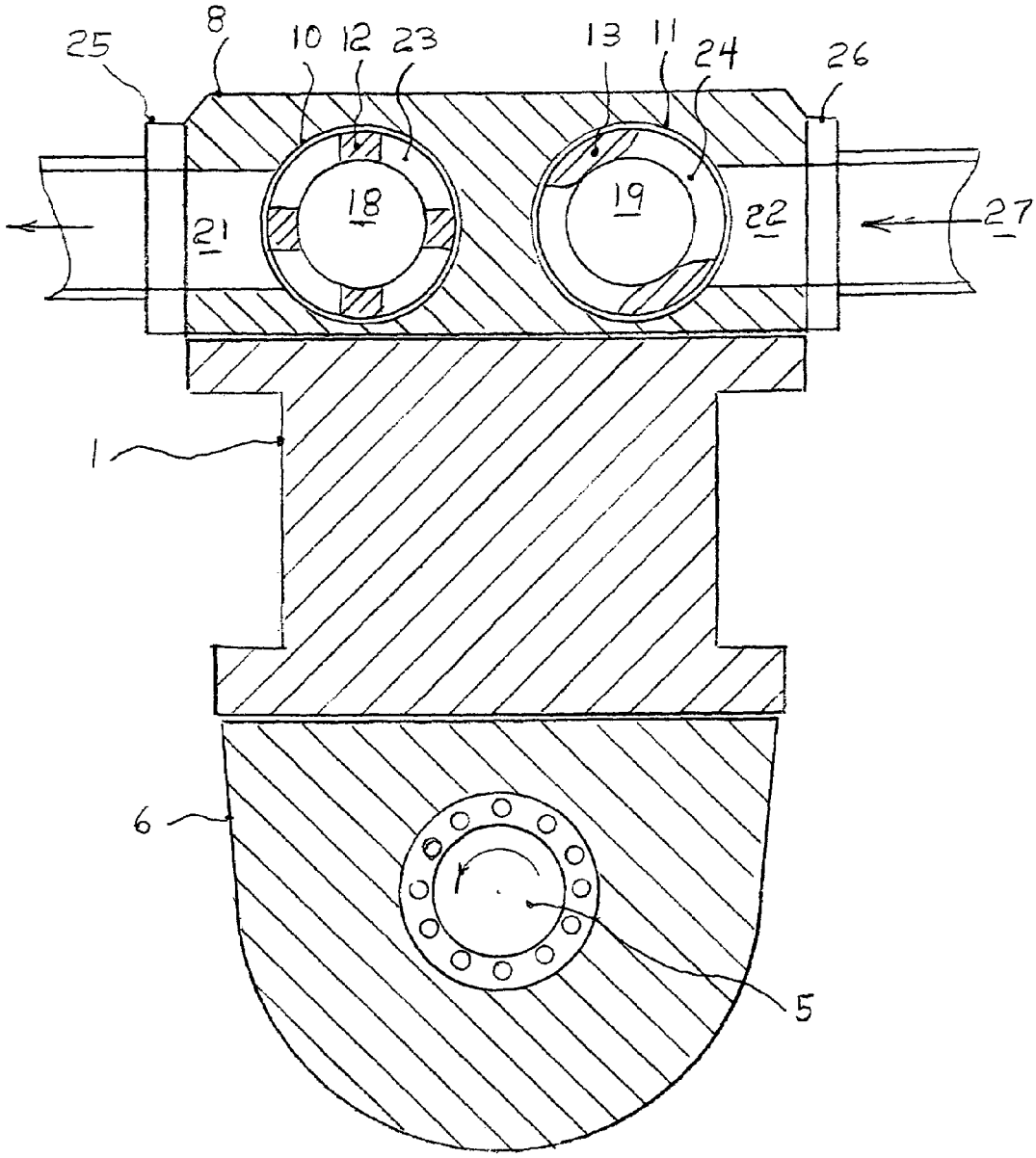
FIG. 3 is a sectional view through D—D of FIG. 1.

FIG. 3 is a sectional view through D—D of FIG. 1. More specifically, offset from the exhaust rotary shaft compression chamber port 16 at a linear measurement to provide a unobstructed seal surface on the exhaust rotary shaft 12 are multiple rotary shaft cylinder head exhaust ports 23 aligning to the cylinder head exhaust passageway 21 in the cylinder head 8 from the exhaust rotary shaft bore 10 to exhaust manifold 25. Between the rotary shaft compression chamber exhaust port 16 and the rotary shaft cylinder head exhaust ports 23 in the exhaust rotary shaft 12 is an exhaust rotary shaft passageway 18. Offset from the rotary shaft compression chamber intake port 17 at a linear measurement to provide an unobstructed seal surface on intake rotary shaft 13 are rotary shaft cylinder head intake ports 24 aligned to cylinder head passage way 22. Between the rotary shaft compression chamber intake port 17 and the rotary shaft cylinder head intake ports 24 is an intake rotary shaft passageway 19. Fixed to the cylinder head intake passageway 22 is a throttle body 27.

On the downward cycle of that piston 3 on its intake cycle, air or air/fuel is drawn into that cylinder piston bore 2 via the throttle body 27 cylinder head intake passageway 22, rotary shaft cylinder head intake ports 24, intake rotary shaft passageway 19, rotary shaft compression chamber intake port 17, compression chamber intake port 15 into cylinder piston bore 2. At bottom dead center of piston 3 the intake cycle complete, the rotary shaft compression chamber intake port 17 closes and the piston 3 starts its upward compression cycle.

At top dead center of piston 3 the compression cycle complete spark plug 20 initiates combustion and power cycle starts. At completion of the power cycle of piston 3 the rotary shaft compression chamber exhaust port 16 opens compression chamber exhaust passageway 14 and spent air/fuel is exhausted via compression chamber exhaust passageway 14 rotary shaft compression chamber exhaust passageway 16, exhaust rotary shaft passageway 18, rotary shaft cylinder head exhaust ports 23, cylinder head exhaust passageway 21 exhaust manifold 25 to atmosphere. At the completion of the exhaust cycle piston 3 at top dead center the rotary shaft compression chamber exhaust port 17 closes and cycles are repeated.

Figure 4:
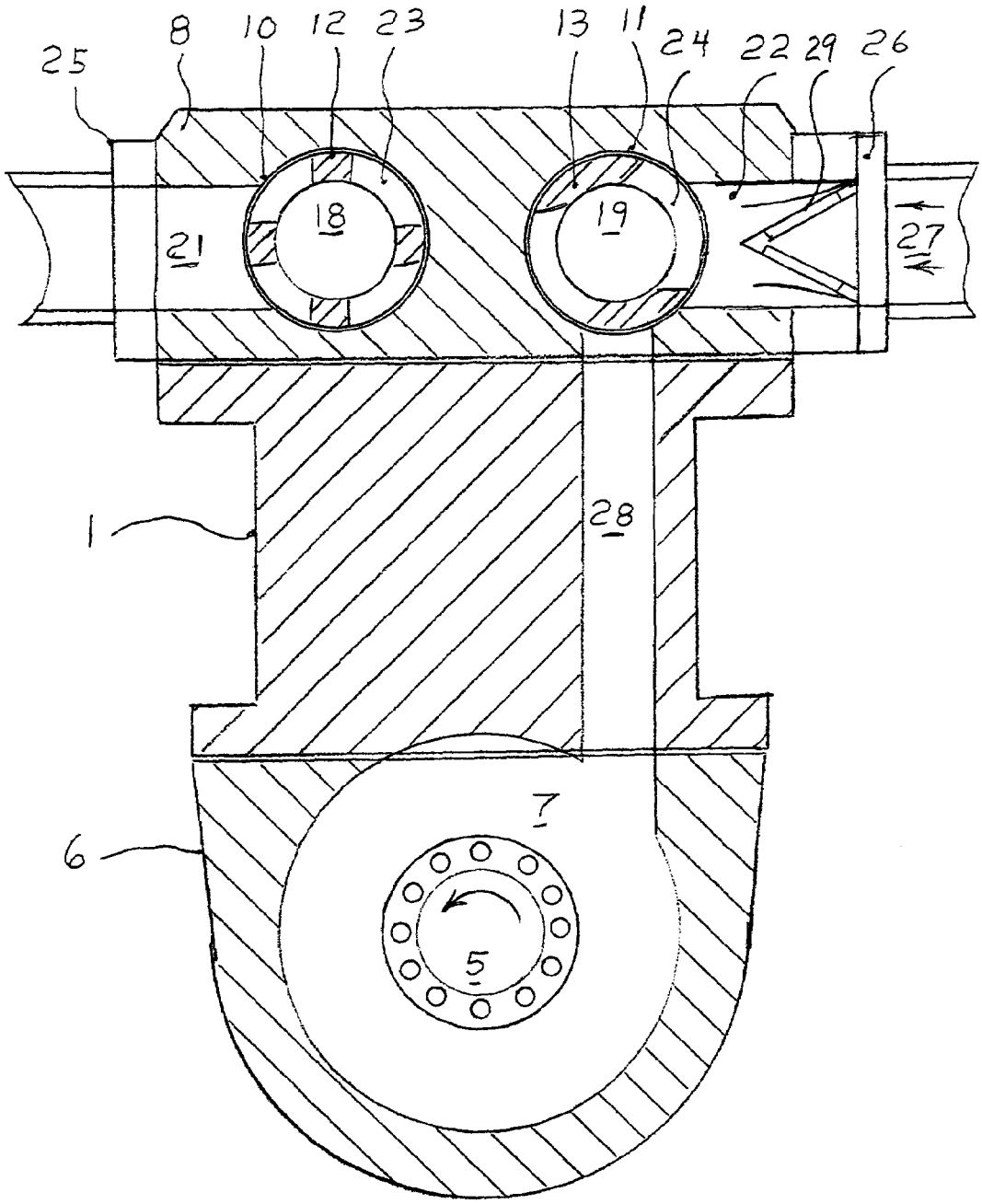
FIG. 4 is a sectional view through B—B of FIG. 1, illustrating super-atmospherically charged on demand functionality, in accordance with an embodiment the present invention.
Figure 5:
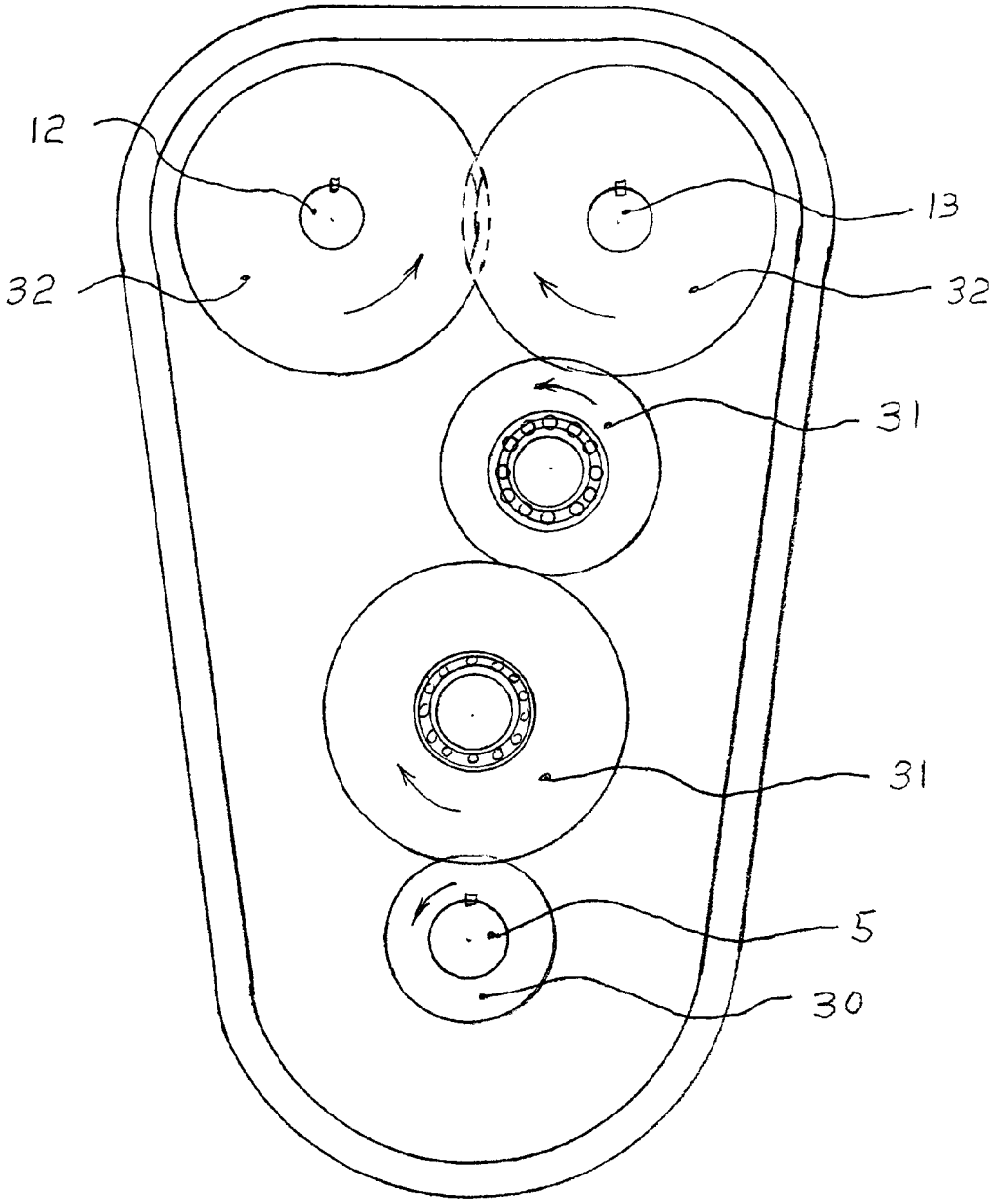
FIG. 5 is a sectional view through C—C of FIG. 1.

FIG. 5 is a sectional view through C—C of FIG. 1. The exhaust rotary shaft 12 and the intake rotary shaft 13 are driven from the crankshaft 5 at exactly one rotation to two rotations of the crankshaft 5, via crankshaft drive gear 30, idle gear 31, and rotary shaft gears 32, to create the four cycle function of the engine. The ports and passageways of all the components are machined in such a manner to provide an unrestricted programmable flow into and out of the engine for the maximum efficiency. In addition, embodiments of the present invention provide super-atmospherically charged on demand functionality, as described next with reference to FIG. 4.

FIG. 4 is a sectional view through B—B of FIG. 1, illustrating super-atmospherically charged on demand functionality, in accordance with an embodiment the present invention. In addition to the components set forth above, for the super-atmospherically charged on demand function of the engine is a crankcase passageway 28 from the crankcase chamber 7 to the cylinder head intake rotary bore 11. Fixed between the cylinder head intake passageway 22 and the throttle body 27 is a single directional in only valve 29 that prevents air or air/fuel flow to exit from the cylinder head intake passageway 22 to the atmosphere.

This function requires two piston bores 2 and two pistons 3 reciprocating together in the same direction sharing the same totally closed minimal volume crankcase chamber 7 or multiples of two sharing their own separate crank chamber 7. As the pistons 3 start their upward cycles, one on its exhaust cycle and the other on its compression cycle, air or air/fuel or that amount desired through the throttle body 27 of both piston 3 is drawn into the crankcase chamber 7 via the throttle body 27, single directional in only valve 29, cylinder head intake passageway 22 rotary shaft cylinder head intake ports 24 crankcase passageway 28 into the crankcase chamber 7.

At the completion of these cycles the rotary shaft cylinder head intake port 24 closes the crankcase passageway 28 and the crankcase chamber 7 volume is compressed on the downward travel of pistons 3. That piston 3 on its intake cycle draws in air/air/fuel via the throttle body 27 single direction in only valve 29 cylinder head intake passageway 22, rotary shaft cylinder head intake port 24, intake rotary shaft passageway 19, rotary shaft compression chamber intake port 17, compression chamber intake passageway 15 into cylinder piston bore 2.

At a predetermined degree on the downward motion of piston 3 approximately 150 degrees after top dead center compressing air or air/fuel in crankcase chamber 7 intake rotary shaft 13 opens crankcase passageway 28 and the compressed volume in crankcase chamber 7 is transferred through crankcase passageway 28 rotary shaft cylinder head intake port 24 intake rotary shaft passageway 19 rotary shaft compression chamber intake passageway 15 into that cylinder piston bore 2 on its intake cycle creating a super-atmospherically charge in that cylinder piston bore 2. These motions are then repeated for that other cylinder piston bore 2 on it intake cycle.

While the invention has been described by reference to specific embodiments chosen for the purpose of illustration, it should be apparent that numerous modifications could be made thereto by those skilled in the art without departing from the spirit and scope of the invention.

What is claimed is:

1. An internal combustion engine, comprising:

a crankcase chamber connected to dual cylinder piston bores, each cylinder piston bore having a piston disposed therein, each piston configured to reciprocate in a same direction within the cylinder piston bores;

a crankcase passageway connected to the crankcase chamber, the crankcase passageway capable of receiving air via a throttle body; and an intake mechanism in communication with the crankcase passageway and the dual cylinder piston bores, the intake mechanism configured to allow airflow between the crankcase passageway and the throttle body during an exhaust stroke of a piston and a compression stroke of another piston, the intake mechanism further configured to allow airflow between the crankcase chamber and the cylinder piston bore via the crankcase passageway during an intake stroke of the piston and the power stroke of the other piston.

2. An internal combustion engine as recited in claim 1, wherein the intake mechanism is configured to block airflow out of the crankcase chamber via the crankcase passageway during a first portion of an intake stroke of the piston.

3. An internal combustion engine as recited in claim 2, wherein the intake mechanism further is configured to allow airflow between the crankcase chamber and the cylinder piston bore via the crankcase passageway during a second portion of the intake stroke of the piston.

4. An internal combustion engine as recited in claim 3, wherein the second portion of the intake stroke occurs at a predetermined degree on the intake stroke of the piston.

5. An internal combustion engine as recited in claim 4, wherein the predetermined degree on the intake stroke of the piston is about 150 degrees after top dead center.

6. An internal combustion engine as recited in claim 1, wherein the intake mechanism is an intake rotary shaft.

7. An internal combustion engine as recited in claim 5, wherein the intake rotary shaft closes the crankcase passageway during the first portion of the intake stroke of the piston.

8. An internal combustion engine as recited in claim 6, wherein the intake rotary shaft opens the crankcase passageway during the second portion of the intake stroke of the piston.

9. An internal combustion engine, comprising:

a first piston deposed within a first cylinder piston bore and a second piston disposed within a second cylinder piston bore, the first cylinder piston bore and the second cylinder piston bore each being connected to a crankcase chamber;

a crankcase passageway connected to the crankcase chamber, the crankcase passageway capable of receiving air via a throttle body; and an intake mechanism positioned to allow airflow between the crankcase passageway and the first and second cylinder piston bores, the intake mechanism configured to allow airflow between the crankcase passageway and the throttle body during an exhaust stroke of the first piston and a compression stroke the second piston, the intake mechanism further configured to block airflow out of the crankcase chamber via the crankcase passageway during a first portion on an intake stroke of the first piston, the intake mechanism further configured to allow airflow between the crankcase chamber and the first cylinder piston bore via the crankcase passageway at a predetermined degree on the intake stroke of the first piston.

10. An internal combustion engine as recited in claim 9, wherein the second piston is on a power stroke when the first piston is on the intake stroke.

11. An internal combustion engine as recited in claim 9, wherein the intake mechanism further is configured to block airflow out of the crankcase chamber via the crankcase passageway during a first portion on an intake stroke of the second piston and a power stroke of the first piston.

12. An internal combustion engine as recited in claim 11, wherein the intake mechanism further is configured to allow airflow between the crankcase chamber and the second cylinder piston bore via the crankcase passageway at a predetermined degree on the intake stroke of the second piston and the power stroke of the first piston.

13. An internal combustion engine as recited in claim 9, wherein the intake mechanism is an intake rotary shaft.

14. An internal combustion engine as recited in claim 13, wherein the intake rotary shaft closes the crankcase passageway during the first portion of the intake stroke of a piston.

15. An internal combustion engine as recited in claim 14, wherein the intake rotary shaft opens the crankcase passageway during the second portion of the intake stroke of a piston.

* * * * *